US010787622B2

(12) United States Patent
Zhang et al.

(10) Patent No.: US 10,787,622 B2
(45) Date of Patent: Sep. 29, 2020

(54) LUBRICATING COMPOSITION FOR LEAD AND COPPER CORROSION INHIBITION

(71) Applicant: The Lubrizol Corporation, Wickliffe, OH (US)

(72) Inventors: Yanshi Zhang, Solon, OH (US); Jody A. Kocsis, Chagrin Falls, OH (US); Mark J. McGuiness, Chagrin Falls, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 132 days.

(21) Appl. No.: 15/529,146

(22) PCT Filed: Dec. 17, 2014

(86) PCT No.: PCT/US2014/070889

§ 371 (c)(1),
(2) Date: May 24, 2017

(87) PCT Pub. No.: WO2016/099490

PCT Pub. Date: Jun. 23, 2016

(65) Prior Publication Data

US 2017/0260475 A1 Sep. 14, 2017

(51) Int. Cl.

| | |
|---|---|
| ***C10M 169/04*** | (2006.01) |
| ***C10M 139/00*** | (2006.01) |
| ***C10M 141/12*** | (2006.01) |
| ***C10M 133/44*** | (2006.01) |
| ***C10M 135/10*** | (2006.01) |
| ***C10M 137/10*** | (2006.01) |
| *C10N 30/06* | (2006.01) |
| *C10N 30/10* | (2006.01) |
| *C10N 30/12* | (2006.01) |
| *C10N 30/00* | (2006.01) |
| *C10N 40/25* | (2006.01) |
| *C10N 60/14* | (2006.01) |

(52) U.S. Cl.

CPC ..... *C10M 141/12* (2013.01); *C10M 133/44* (2013.01); *C10M 135/10* (2013.01); *C10M 137/10* (2013.01); *C10M 2203/1006* (2013.01); *C10M 2203/1025* (2013.01); *C10M 2215/086* (2013.01); *C10M 2215/223* (2013.01); *C10M 2219/046* (2013.01); *C10M 2219/066* (2013.01); *C10M 2219/087* (2013.01); *C10M 2223/045* (2013.01); *C10M 2227/061* (2013.01); *C10N 2030/06* (2013.01); *C10N 2030/10* (2013.01); *C10N 2030/12* (2013.01); *C10N 2030/42* (2020.05); *C10N 2030/43* (2020.05); *C10N 2030/45* (2020.05); *C10N 2030/52* (2020.05); *C10N 2040/25* (2013.01); *C10N 2040/252* (2020.05); *C10N 2060/14* (2013.01)

(58) Field of Classification Search

CPC C10M 135/18; C10M 139/06; C10M 141/12; C10M 133/44; C10M 135/10; C10M 137/10; C10M 2219/066; C10M 2219/087; C10M 2203/1025; C10M 2215/086; C10M 2203/1006; C10M 2215/223; C10M 2219/046; C10M 2223/045; C10M 2227/061; C10N 2030/10; C10N 2030/12; C10N 2030/42; C10N 2030/43; C10N 2030/45; C10N 2040/25; C10N 2040/252; C10N 2060/14

USPC ..... 508/198, 287

See application file for complete search history.

(56) References Cited

U.S. PATENT DOCUMENTS

| | | | | |
|---|---|---|---|---|
| 5,693,598 | A * | 12/1997 | Abraham | C10M 141/10 508/404 |
| 5,759,965 | A | 6/1998 | Sumiejski | |
| 2007/0203031 | A1* | 8/2007 | Bardasz | C10M 133/56 508/192 |
| 2008/0171677 | A1 | 7/2008 | Buck et al. | |

FOREIGN PATENT DOCUMENTS

| | | | |
|---|---|---|---|
| WO | 2012/122202 | A1 | 9/2012 |
| WO | 2014/164087 | A1 | 10/2014 |

* cited by examiner

*Primary Examiner* — Prem C Singh
*Assistant Examiner* — Francis C Campanell
(74) *Attorney, Agent, or Firm* — Michael Miller; Eryn Fuhrer; Teresan Gilbert

(57) ABSTRACT

The invention provides a lubricating composition containing an oil of lubricating viscosity, an ashless thiocarbamate compound having an optionally-substituted hydrocarbyl group on an S-atom and an optionally-substituted hydrocarbyl group on an N-atom, and a boron-containing compound. The invention further relates to a method of lubricating an internal combustion engine with the lubricating composition.

25 Claims, No Drawings

LUBRICATING COMPOSITION FOR LEAD AND COPPER CORROSION INHIBITION

CROSS REFERENCE TO RELATED APPLICATION

This application claims priority from PCT Application Serial No. PCT/US2014/070889 filed on Dec. 17, 2014, the entirety of which is hereby incorporated by reference.

FIELD OF INVENTION

The invention provides a lubricating composition containing an oil of lubricating viscosity, an ashless thiocarbamate compound having an optionally-substituted hydrocarbyl group on an S-atom and an optionally-substituted hydrocarbyl group on an N-atom, and a boron-containing compound. The invention further relates to the use of the lubricating composition in an internal combustion engine.

BACKGROUND OF THE INVENTION

It is well known for lubricating oils to contain a number of surface active additives (including antiwear agents, dispersants, or detergents) used to protect internal combustion engines from wear, soot deposits and acid build up. Often, such surface active additives including zinc dialkyldithiophosphates (common antiwear additive for engine lubricating oils is zinc dialkyldithiophosphate (ZDDP)) or dispersants can have harmful effects on bearing corrosion, dispersancy or friction performance.

Many of these additive chemistries are corrosive to lead or copper. It is difficult for formulators to meet the present engine oil specifications by employing certain beneficial additives while also meeting the specification for lead or copper corrosion. With introduction of industry specifications and legislation to reduce emissions there are tighter limits on ash-containing, sulfur-containing and phosphorus-containing limits have been introduced. For example, industry specifications such as API CJ-4, as well as MACK T-11 and Mack T-12 tests, have been introduced for heavy duty diesel engines.

There has been a commercial trend for reduction in emissions (typically reduction of NOx formation, SOx formation) and a reduction in sulfated ash in engine oil lubricants. Consequently, the amounts of phosphorus-containing antiwear agents such as ZDDP, overbased detergents such as calcium or magnesium sulfonates and phenates have been reduced. As a consequence, ashless additives have been contemplated to provide friction or antiwear performance. It is known that surface active ashless compounds such as ashless dispersants may in some instances increase corrosion of metal, namely, copper or lead. Copper and lead corrosion may be from bearings and other metal engine components derived from alloys using copper or lead. Consequently, there is a need to reduce the amount of corrosion caused by ashless additives.

SUMMARY OF THE INVENTION

The invention is directed to a lubricating composition that is capable of providing at least one of antiwear performance, friction modification (particularly for enhancing fuel economy), extreme pressure performance, antioxidant performance, lead and copper corrosion inhibition, or seal swell performance. In one embodiment, the invention is directed to a lubricating composition that is capable of providing at least one of lead or copper corrosion inhibition. In one embodiment, the invention is directed to a lubricating composition that is capable of providing lead corrosion inhibition without deleteriously effecting copper corrosion inhibition.

As used herein reference to the amounts of additives present in the lubricating composition disclosed herein are quoted on an oil free basis, i.e., amount of actives.

In one embodiment, the invention provides a lubricating composition comprising an oil of lubricating viscosity, an ashless thiocarbamate compound having an optionally-substituted hydrocarbyl group on an S-atom and an optionally-substituted hydrocarbyl group on an N-atom, and a boron-containing compound.

In one embodiment, the invention provides a lubricating composition comprising an oil of lubricating viscosity and an ashless thiocarbamate compound having an optionally-substituted hydrocarbyl group on an S-atom and an optionally-substituted hydrocarbyl group on an N-atom, wherein the S-hydrocarbyl atom may be free of a nitrogen-containing heterocycle, and a boron-containing compound.

In one embodiment, the invention provides a lubricating composition comprising an oil of lubricating viscosity and an ashless thiocarbamate compound having an optionally-substituted hydrocarbyl group on an S-atom and an optionally-substituted hydrocarbyl group on an N-atom, wherein the N-hydrocarbyl group may be free of a cyclic carbonyl group, and a boron-containing compound.

In one embodiment, the invention provides a lubricating composition comprising an oil of lubricating viscosity and an ashless thiocarbamate compound having an optionally-substituted hydrocarbyl group on an S-atom and an optionally-substituted hydrocarbyl group on an N-atom, wherein the N-hydrocarbyl group may be free of a cyclic carbonyl group, the S-hydrocarbyl group may be free of a nitrogen-containing heterocycle, and a boron-containing compound.

In one embodiment, the invention provides a method of lubricating an internal combustion engine comprising supplying to the internal combustion engine a lubricating composition as disclosed herein.

In one embodiment, the invention provides a method of lubricating an internal combustion engine comprising supplying to the internal combustion engine a lubricating composition as disclosed herein, wherein the engine has a steel surface on a cylinder bore, a cylinder block, or a piston ring.

In one embodiment, the invention provides a method of lubricating a heavy duty diesel internal combustion engine comprising supplying to the heavy duty diesel internal combustion engine a lubricating composition as disclosed herein.

In one embodiment, the invention provides for the use of the ashless thiocarbamate compound having an optionally-substituted hydrocarbyl group on an S-atom and an optionally-substituted hydrocarbyl group on an N-atom disclosed herein as a copper corrosion additive and/or lead corrosion additive in an internal combustion engine.

In one embodiment, the invention provides for the use of the ashless thiocarbamate compound having an optionally-substituted hydrocarbyl group on an S-atom and an optionally-substituted hydrocarbyl group on an N-atom disclosed herein as a copper corrosion additive and/or lead corrosion additive in a heavy duty diesel internal combustion engine.

In one embodiment, the invention provides a lubricating composition wherein the ashless thiocarbamate compound having an optionally-substituted hydrocarbyl group on an S-atom and an optionally-substituted hydrocarbyl group on an N-atom may be present at 0.01 wt % to 5 wt %, or 0.025 wt % to 2.0 wt %, or 0.05 wt % to 1 wt %, or 0.1 wt % to 0.5 wt % of the lubricating composition, and the boron-containing compound may be present in an amount to provide a boron level of 5 ppm to 2000 ppm, or 15 ppm to 600 ppm, or 20 ppm to 300 ppm.

In one embodiment, the invention provides a lubricating composition wherein the ashless thiocarbamate compound having an optionally-substituted hydrocarbyl group on an S-atom and an optionally-substituted hydrocarbyl group on an N-atom may be present at 0.25 wt % to 1 wt % of the lubricating composition.

In one embodiment, the invention provides a lubricating composition comprising an oil of lubricating viscosity, an ashless thiocarbamate compound having an optionally-substituted hydrocarbyl group on an S-atom and an optionally-substituted hydrocarbyl group on an N-atom, and a boron-containing compound, wherein the boron-containing compound may be present in an amount to provide a boron concentration of 15 ppm to 600 ppm, or from 20 ppm to 300 ppm.

In one embodiment, the invention provides a lubricating composition wherein the boron-containing compound is an borate ester.

The lubricating composition may have a TBN (Total Base Number as measured by ASTM D2896) in the range of 3 to 15, or 4 to 12, or 6 to 10 mg KOH/g.

DETAILED DESCRIPTION OF THE INVENTION

The invention described herein provides a lubricating composition, a method for lubricating an engine as disclosed above, and a use of the ashless thiocarbamate and boron-containing compounds as disclosed above.

Ashless Thiocarbamate

The ashless thiocarbamate compound having an optionally-substituted hydrocarbyl group on an S-atom and an optionally-substituted hydrocarbyl group on an N-atom may be represented by the formula (1)

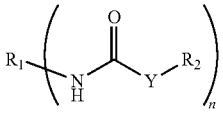

wherein n may be 1 or 2;

Y may be oxygen or sulfur, provided that when n=1, Y is sulfur, and when n=2, at least one Y is sulfur;

$R_1$ may be an optionally-substituted hydrocarbyl group. $R_1$ may contain 2 to 60, or 4 to 30, or 6 to 20 carbon atoms, or a heterocycle (or substituted equivalents thereof), with the proviso that $R_1$ may be free of a nitrogen-containing heterocycle; and $R_2$ may be an optionally-substituted hydrocarbyl group or an optionally-substituted hydrocarbylene group [i.e., 2 points of attachment]. $R_2$ may contain 2 to 60, or 4 to 30, or 6 to 20 carbon atoms, or a heterocycle (or substituted equivalents thereof).

As used herein, the expression "optionally-substituted hydrocarbyl" is intended to include hydrocarbyl groups that have substituents that are more polar than a hydrocarbon group. Examples of polar groups include esters, heterocycles, amides, imides, phosphates, sulfonates, sulphates, nitrates, nitriles, or ethers. The optionally-substituted hydrocarbylene group is defined substantially the same as optionally-substituted hydrocarbyl, except the hydrocarbylene group has 2 points of attachment.

The ashless thiocarbamate compound having an optionally-substituted hydrocarbyl group on an S-atom and an optionally-substituted hydrocarbyl group on an N-atom may be represented by the formula (2):

formula (2)

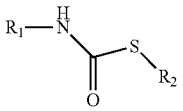

wherein $R_1$ may be an optionally-substituted hydrocarbyl group containing 2 to 60, or 4 to 30, or 6 to 20 carbon atoms, or a heterocycle (or substituted equivalents thereof); and $R_2$ may be a hydrocarbyl group containing 2 to 60, or 4 to 30, or 6 to 20 carbon atoms, or a heterocycle (or substituted equivalents thereof) with the proviso that $R_2$ (i.e., the S-hydrocarbyl atom) may be free of a nitrogen-containing heterocycle.

The ashless thiocarbamate compound having an optionally-substituted hydrocarbyl group on an S-atom and an optionally-substituted hydrocarbyl group on an N-atom may be represented by the formula (3):

formula (3)

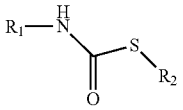

wherein $R_1$ may be an optionally-substituted hydrocarbyl group (typically a hydrocarbyl group containing 2 to 60, or 4 to 30, or 6 to 20 carbon atoms, or a heterocycle (or substituted equivalents thereof), with the proviso that $R_1$ may be free of a nitrogen-containing heterocycle); and $R_2$ may be an optionally substituted hydrocarbyl group (typically a hydrocarbyl group containing 2 to 60, or 4 to 30, or 6 to 20 carbon atoms, or a heterocycle (or substituted equivalents thereof) with the proviso that $R_2$ (i.e., the S-hydrocarbyl atom) may be free of a nitrogen-containing heterocycle.

The ashless thiocarbamate compound having an optionally-substituted hydrocarbyl group on an S-atom and an optionally-substituted hydrocarbyl group on an N-atom may be represented by the formula (4):

formula (4)

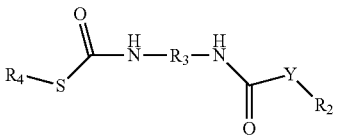

wherein

Y may be >O, or >S, or >NH or >$NR_5$ (typically Y may be >O, or >S);

$R_2$ may be a hydrocarbyl group containing 2 to 60, or 4 to 30, or 6 to 20 carbon atoms, or a heterocycle (or substituted equivalents thereof) with the proviso that $R_2$ (i.e., the S-hydrocarbyl atom) may be free of a nitrogen-containing heterocycle;

$R_3$ may be a hydrocarbylene group (typically containing 1 to 16, or 2 to 10, or 4 to 8, such as 6 carbon atoms), or a heterocycle (or substituted equivalents thereof);

$R_4$ may be a hydrocarbyl group containing 2 to 60, or 4 to 30, or 6 to 20 carbon atoms, or a heterocycle (or substituted equivalents thereof); and $R_5$ may be a hydrocarbyl group containing 1 to 30, or 1 to 20, or 1 to 10, or 1 to 5 carbon atoms.

$R_3$ may be a linear, branched or cyclic group. If $R_3$ is cyclic, it may be aromatic or non-aromatic.

The ashless thiocarbamate compound having an optionally-substituted hydrocarbyl group on an S-atom and an optionally-substituted hydrocarbyl group on an N-atom may contain one or more linear hydrocarbyl groups.

The ashless thiocarbamate compound having an optionally-substituted hydrocarbyl group on an S-atom and an optionally-substituted hydrocarbyl group on an N-atom may contain one linear hydrocarbyl group and one branched hydrocarbyl group. The branched hydrocarbyl group may be an α-branched hydrocarbyl group, or a β-hydrocarbyl group. The branched hydrocarbyl group may, for instance, be a 2-ethylhexyl group.

The ashless thiocarbamate compound having an optionally-substituted hydrocarbyl group on an S-atom and an optionally-substituted hydrocarbyl group on an N-atom may contain one or more cyclic hydrocarbyl groups.

A cyclic hydrocarbyl group may be aromatic or non-aromatic. The cyclic hydrocarbyl group may be a heterocycle or a non-heterocycle.

A non-aromatic hydrocarbyl group may include a cycloalkane, or a pyrrolidinone. Typically, the non-aromatic hydrocarbyl group may be cyclohexane or pyrrolidinone.

As used herein, reference to "a" specific compound such as "a pyrrole", or "a pyrrolidine" and so on is intended to include both the chemical itself (i.e., pyrrole, pyrrolidine), and their substituted equivalents thereof.

A non-heterocycle may include a phenyl group, or a naphthalyl group.

A heterocycle may for instance include a pyrrole, a pyrrolidine, a pyrrolidinone, a pyridine, a piperidine, a pyrone, a pyrazole, a pyrazine, pyridazine, a 1,2-diazole, a 1,3-diazole, a 1,2,4-triazole, a benzotriazole, a quinoline, an indole, an imidazole, an oxazole, an oxazoline, a thiazole, a thiophene, an indolizine, a pyrimidine, a triazine, a furan, a tetrahydrofuran, a dihydrofuran, or mixtures thereof.

In one embodiment, the heterocycle may be a tetrazole, or a triazole (either a 1,2,4-triazole, or a benzotriazole), or a pyridine.

The ashless thiocarbamate compound having an optionally-substituted hydrocarbyl group on an S-atom and an optionally-substituted hydrocarbyl group on an N-atom may contain one cyclic hydrocarbyl group and one linear hydrocarbyl group.

The ashless thiocarbamate compound having an optionally-substituted hydrocarbyl group on an S-atom and an optionally-substituted-hydrocarbyl group on an N-atom may contain one heterocyclic hydrocarbyl group and one linear hydrocarbyl group.

The ashless thiocarbamate compound having an optionally-substituted hydrocarbyl group on an S-atom and an optionally-substituted hydrocarbyl group on an N-atom may be halogen free.

As described herein, ashless thiocarbamate compound having an optionally-substituted hydrocarbyl group on an S-atom and an optionally-substituted hydrocarbyl group on an N-atom may have the N-hydrocarbyl group free of a cyclic carbonyl group or, alternatively, containing a cyclic carbonyl group (generally free of a cyclic carbonyl group). The cyclic carbonyl group may be a saturated or unsaturated system of general formulae (5) or (6):

formula (5)

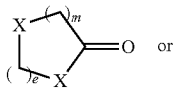

or formula (6)

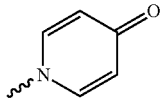

wherein m may be 0, 1 or 2;

X may be a $>NR_6$;

e may be 1 or 2;

the wavy bond is a direct bond to the carbonyl group of the ashless thiocarbamate compound having an optionally-substituted hydrocarbyl group on an S-atom and an optionally-substituted hydrocarbyl group on an N-atom; and $R_6$ may be H, an hydrocarbyl group typically containing 1 to 5, or 1 to 2 carbon atoms, or a direct bond to the carbonyl group of the ashless thiocarbamate compound having an optionally-substituted hydrocarbyl group on an S-atom and an optionally-substituted hydrocarbyl group on an N-atom, with the proviso that at least one of the $R_6$ groups is a direct bond to the carbonyl group of the ashless thiocarbamate compound having an optionally-substituted hydrocarbyl group on an S-atom and an optionally-substituted hydrocarbyl group on an N-atom. Typically when m equals 0, c may be 2; and when m equals 1 or 2, c may be 1.

The ashless thiocarbamate compound having an optionally-substituted hydrocarbyl group on an S-atom and an optionally-substituted hydrocarbyl group on an N-atom may be prepared by a process comprising reacting (i) a hydrocarbyl-substituted isocyanate or a hydrocarbyl-substituted diisocyanate, and (ii) a hydrocarbyl-substituted thiol, optionally in presence of a heterocycle.

The mole ratio of hydrocarbyl-substituted thiol to either the hydrocarbyl-substituted isocyanate or the hydrocarbyl-substituted diisocyanate may vary from 0.5:1 to 3:1, typically 1:1 or 1:2. For a monoisocyanate, the mole ratio may be 0.5:1 to 1.5:1. For a diisocyanate, the mole ratio may be 1:1 to 3:1.

The product of reacting a hydrocarbyl-substituted isocyanate and a hydrocarbyl-substituted thiol may have a structure defined by formulae (2) or (3) above.

The product of reacting a hydrocarbyl-substituted diisocyanate and a hydrocarbyl-substituted thiol may have a structure defined by formula (4) above.

The reaction to prepare the ashless thiocarbamate compound having an optionally-substituted hydrocarbyl group on an S-atom and an optionally-substituted hydrocarbyl group on an N-atom may be carried out at a temperature in the range of 0° C. to 150° C., or 20° C. to 80° C., or 25° C. to 50° C., optionally in the presence of a solvent and optionally in the presence of a catalyst. In one embodiment, the reaction may be carried out in the presence of a catalyst. In one embodiment, the reaction may be carried out in the presence of one or more solvents.

The reaction to prepare the ashless thiocarbamate compound having an optionally-substituted hydrocarbyl group on an S-atom and an optionally-substituted hydrocarbyl group on an N-atom may be carried out in an inert atmosphere or in air. The inert atmosphere may be a nitrogen or argon atmosphere (typically nitrogen).

The solvent may include a polar or non-polar medium. The solvent may for instance include acetone, toluene, xylene, tetrahydrofuran, diluent oil, Acetonitrile, N,N-dimethyl formamide, N,N-dimethyl acetamide, methyl ether ketone, t-butylmethyl ether, dimethoxy ethane, dichloromethane, or dichloroethane, or mixtures thereof.

The catalyst may be a tertiary amine such as tri-$C_{1-5}$-alkyl amine (typically triethylamine), tripropylamine, tributylamine, or diisopropylethylamine, or mixtures thereof.

The hydrocarbyl-substituted thiol (may also be referred to as a mercaptan) may have the hydrocarbyl group defined the same as $R_2$ above (that is to say the hydrocarbyl group may contain 2 to 60, or 4 to 30, or 6 to 20 carbon atoms). Examples of a hydrocarbyl-substituted thiol include ethyl thiol, butyl thiol, hexyl thiol, heptyl thiol, octyl thiol, 2-ethylhexyl thiol, nonyl thiol, decyl thiol, undecyl thiol, dodecyl thiol, tridecyl thiol, butadecyl thiol, pentadecyl thiol, hexadecyl thiol, heptadecyl thiol, octadecyl thiol, nonadecyl thiol, eicosyl thiol, or mixtures thereof.

The hydrocarbyl-substituted isocyanate may have the optionally-substituted hydrocarbyl group defined the same as $R_1$ above (that is to say the hydrocarbyl group may contain 2 to 60, or 4 to 30, or 6 to 20 carbon atoms). Examples of a hydrocarbyl-substituted isocyanate include cyclohexyl isocyanate, methyl isocyanate, ethyl isocyanate, propyl isocyanate, butyl isocyanate, pentylisocyanate, hexylisocyanate, heptylisocyanate, octylisocyanate, nonylisocyanate, decylisocyanate, undecyl isocyanate, dodecyl isocyanate, tridecyl isocyanate, tetradecyl isocyanate, pentadecyl isocyanate, hexadecyl isocyanate, heptadecyl isocyante, ocatadecyl isocyanate, nonadecyl isocyanate, allyl isocyanate, phenyl isocyanate, and its derivatives, such as benzyl isocyanate, tolyl isocyanate, ethylphenyl isocyanate, chlorophenyl isocyanate, or naphthyl isocyanate.

The hydrocarbyl-substituted diisocyanate may have the hydrocarbylene group defined the same as $R_3$ (that is to say the hydrocarbylene group may contain 1 to 16, or 2 to 10, or 4 to 8, such as 6 carbon atoms). Examples of a hydrocarbyl-substituted diisocyanate include isophorone diisocyanate, methylene-di-p-phenyl-diisocyanate, methylenediisocyanate, ethylenediisocyanate, diisocyanatobutane, diisocyanatohexane, cyclohexylene diisocyanate, toluene diisocyanate and methylene dicyclohexyl diisocyanate.

The hydrocarbyl-substituted diisocyanate may also have $R_4$ defined the same as $R_2$.

The hydrocarbyl-substituted diisocyanate compound may also be partially reacted with a hydrocarbyl-substituted thiol. Partial reaction may occur when there is a mole excess of the hydrocarbyl-substituted diisocyanate. In this situation, the product of reacting the hydrocarbyl-substituted diisocyanate with the hydrocarbyl-substituted thiol may be represented by formula (4), when Y is >O.

The Boron-Containing Compound

In one embodiment, the lubricating composition of the invention includes a boron-containing compound. In one embodiment the boron-containing compound includes a borate ester or a borated alcohol.

The borate ester may be prepared by the reaction of a boron compound and at least one compound selected from epoxy compounds, halohydrin compounds, epihalohydrin compounds, alcohols and mixtures thereof. The alcohols include dihydric alcohols, trihydric alcohols or higher alcohols, with the proviso for one embodiment that hydroxyl groups are on adjacent carbon atoms, i.e., vicinal.

Boron compounds suitable for preparing the borate ester include the various forms selected from the group consisting of boric acid (including metaboric acid, $HBO_2$, orthoboric acid, $H_3BO_3$, and tetraboric acid, $H_2B_4O_7$), boric oxide, boron trioxide and alkyl borates. The borate ester may also be prepared from boron halides.

In one embodiment, suitable borate ester compounds triethyl borate, tripropyl borate, triisopropyl borate, tributyl borate, tripentyl borate, trihexyl borate, tricyclohexyl borate, trioctyl borate, triisooctyl borate, tridecyl borate, tri ($C_{8-10}$) borate, tri ($C_{12-15}$ borate) and oleyl borate, or mixtures thereof.

In one embodiment, the boron-containing compound is a borated fatty acid ester of glycerol. The borated fatty acid esters of glycerol are prepared by borating a fatty acid ester of glycerol with boric acid with removal of the water of reaction. Preferably, there is sufficient boron present such that each boron will react with from 1.5 to 2.5 hydroxyl groups present in the reaction mixture.

The reaction may be carried out at a temperature in the range of 60° C. to 135° C., in the absence or presence of any suitable organic solvent such as methanol, benzene, xylenes, toluene, neutral oil and the like.

Fatty acid esters of glycerol can be prepared by a variety of methods well known in the art. Many of these esters, such as glycerol monooleate and glycerol tallowate, are manufactured on a commercial scale. The esters useful for this invention are oil-soluble and are preferably prepared from $C_8$ to $C_{22}$ fatty acids or mixtures thereof such as are found in natural products. The fatty acid may be saturated or unsaturated. Certain compounds found in acids from natural sources may include licanic acid which contains one keto group. Most preferred $C_8$ to $C_{22}$ fatty acids are those of the formula R—COOH wherein R is alkyl or alkenyl.

In one embodiment, the fatty acid ester of glycerol is a monoester of glycerol, however, mixtures of mono- and diesters may be used. Preferably, any mixture of mono- and diester contains at least 40% of the monoester. In one embodiment, mixtures of mono- and diesters of glycerol contain from 40 to 60 percent by weight of the monoester. For example, commercial glycerol monooleate contains a mixture of from 45% to 55% by weight monoester and from 55% to 45% diester.

In one embodiment, the fatty acids include oleic, stearic, isostearic, palmitic, myristic, palmitoleic, linoleic, lauric, linolenic, and eleostearic, and the acids from the natural products tallow, palm oil, olive oil, peanut oil, corn oil, neat's foot oil and the like. In one embodiment, the fatty acid is oleic acid.

The boron-containing compound may be employed in the inventive lubricating oil composition at a sufficient concentration to provide the lubricating oil composition with a boron level in the range of from 5 ppm to 2000 ppm, and in one embodiment 15 ppm to 600 ppm, and in one embodiment 20 ppm to 300 ppm.

Oils of Lubricating Viscosity

The lubricating composition comprises an oil of lubricating viscosity.

Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerized Fischer-Tropsch hydrocarbons or waxes. In one embodiment, oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil. In one embodiment, the oil of lubricating viscosity may be an API Group I oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives may include at least one of metal deactivators, viscosity modifiers, detergents, friction modifiers, antiwear agents (other than the ashless thiocarbamate compound having an optionally-substituted hydrocarbyl group on an S-atom and an optionally-substituted hydrocarbyl group on an N-atom of the present invention), corrosion inhibitors (other than the carbamate of the present invention), dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment, the lubricating composition further includes other additives. In one embodiment, the invention provides a lubricating composition further comprising at least one of a dispersant, an antiwear agent, a dispersant viscosity modifier, a friction modifier, a corrosion inhibitor (other than the carbamate of the present invention), a viscosity modifier, an antioxidant, an overbased detergent, or mixtures thereof. In one embodiment, the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulfonates and phenates), or mixtures thereof.

The dispersant of the present invention may be a succinimide dispersant, or mixtures thereof. In one embodiment, the dispersant may be present as a single dispersant. In one embodiment, the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment, the aliphatic polyamine may be ethylenepolyamine. In one embodiment, the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The dispersant may also be derived from a material having an aromatic amine. The aromatic amine that may be useful is disclosed in International publications WO2010/062842 and WO2009/064685 (a similar disclosure is provided in US 2010/298185). The aromatic amine of WO2009/064685 is typically reacted with isatoic anhydride.

The aromatic amine may typically not be a heterocycle. The aromatic amine may include aniline, nitro aniline, aminocarbazole, 4-aminodiphenylamine (ADPA), and coupling products of ADPA. In one embodiment, the amine may be 4-aminodiphenylamine (ADPA), or coupling products of ADPA. The aromatic amine may include bis[p-(p-aminoanilino)phenyl]-methane, 2-(7-amino-acridin-2-ylmethyl)-N-4-{4-[4-(4-amino-phenylamino)-benzyl]-phenyl}-benzene-1,4-di-amine, N-{4-[4-(4-amino-phenylamino)-benzyl]-phenyl}-2-[4-(4-amino-phenyl-amino)-cyclohexa-1,5-dienylmethyl]-benzene-1,4-diamine, N-[4-(7-amino-acridin-2-ylmethyl)-phenyl]-benzene-1,4-diamine, or mixtures thereof.

The dispersant may be a N-substituted long chain alkenyl succinimide.

Examples of N-substituted long chain alkenyl succinimide include polyisobutylene succinimide. Typically, the polyisobutylene from which polyisobutylene succinic anhydride is derived has a number average molecular weight of 350 to 5000, or 550 to 3000 or 750 to 2500. Succinimide dispersants and their preparation are disclosed, for instance, in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersant may also be post-treated by conventional methods by a reaction with any of a variety of agents. Among these are boron compounds, urea, thiourea, dimercaptothiadiazoles, carbon disulfide, aldehydes, ketones, carboxylic acids, hydrocarbon-substituted succinic anhydrides, maleic anhydride, nitriles, epoxides, and phosphorus compounds.

The dispersant may be present at 0.1 wt % to 10 wt %, or 2.5 wt % to 6 wt %, or 3 wt % to 5 wt % of the lubricating composition.

In one embodiment, the lubricating composition of the invention further comprises a dispersant viscosity modifier. The dispersant viscosity modifier may be present at 0 wt % to 5 wt %, or 0 wt % to 4 wt %, or 0.05 wt % to 2 wt % of the lubricating composition.

The dispersant viscosity modifier may include functionalized polyolefins, for example, ethylene-propylene copolymers that have been functionalized with an acylating agent such as maleic anhydride and an amine; polymethacrylates functionalized with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment, the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment, the dispersant viscosity modifier may include those described in U.S. Pat. No. 7,790,661 column 2, line 48 to column 10, line 38. The dispersant viscosity modifier of U.S. Pat. No. 7,790,661 includes (a) a polymer comprising carboxylic acid functionality or a reactive equivalent thereof, said polymer having a number average molecular weight of greater than 5,000; and (b) an amine component comprising at least one aromatic amine containing at least one amino group capable of condensing with said carboxylic acid functionality to provide a pendant group and at least one additional group comprising at least one nitrogen, oxygen, or sulfur atom, wherein said aromatic amine is selected from the group consisting of (i) a nitro-substituted aniline, (ii) amines comprising two aromatic moieties linked by a —C(O)NR— group, a —C(O)O— group, an —O— group, an —N—N— group, or an —$SO_2$— group, wherein R is hydrogen or hydrocarbyl, one of said aromatic moieties bearing said condensable amino group, (iii) an aminoquinoline, (iv) an aminobenzimidazole, (v) an N,N-dialkylphenylenediamine, and (vi) a ring-substituted benzylamine.

In one embodiment, the invention provides a lubricating composition which further includes a phosphorus-containing antiwear agent. Typically, the phosphorus-containing antiwear agent may be a zinc dialkyldithiophosphate, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

In one embodiment, the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

In one embodiment, the invention provides a lubricating composition further comprising an overbased detergent. The overbased detergent may be selected from the group consisting of non-sulfur containing phenates, sulfur containing phenates, sulfonates, salixarates, salicylates, and mixtures thereof.

The overbased detergent may also include "hybrid" detergents formed with mixed surfactant systems including phenate and/or sulfonate components, e.g., phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively.

Typically an overbased detergent may be sodium, calcium or magnesium salt of the phenates, sulfur containing phenates, sulfonates, salixarates and salicylates. Overbased phenates and salicylates typically have a total base number of 180 to 450 TBN. Overbased sulfonates typically have a total base number of 250 to 600, or 300 to 500. Overbased detergents are known in the art. In one embodiment, the sulfonate detergent may be a predominantly linear alkylbenzene sulfonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulfonate detergent may be particularly useful for assisting in improving fuel economy. In one embodiment, the sulfonate detergent may be a metal salt of one or more oil-soluble alkyl toluene sulfonate compounds as disclosed in paragraphs [0046] to [0053] of US Patent Application 2008/0119378. The overbased detergent may be present at 0 wt % to 15 wt %, or 1 wt % to 10 wt %, or 3 wt % to 8 wt %. For example, in a heavy duty diesel engine, the detergent may be present at or 3 wt % to 5 wt % of the lubricating composition. For a passenger car engine, the detergent may be present at 0.2 wt % to 1 wt % of the lubricating composition.

In one embodiment, the lubricating composition includes an antioxidant, or mixtures thereof. The antioxidant may be present at 0 wt % to 15 wt 5, or 0.1 wt % to 10 wt %, or 0.5 wt % to 5 wt % of the lubricating composition.

Antioxidants include sulfurized olefins, alkylated diphenylamines (typically dinonyl diphenylamine, octyl diphenylamine, dioctyl diphenylamine), phenyl-a-naphthylamine (PANA), hindered phenols, molybdenum compounds (such as molybdenum dithiocarbamates), or mixtures thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment, the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulfurized fatty compounds and olefins, molybdenum dialkyldithiophosphates, molybdenum dithiocarbamates, sunflower oil or monoester of a polyol and an aliphatic carboxylic acid.

In one embodiment, the friction modifier may be selected from the group consisting of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition. In one embodiment, the lubricating composition may be free of long chain fatty esters (typically glycerol monooleate).

As used herein, the term "fatty alkyl" or "fatty" in relation to friction modifiers means a carbon chain having 10 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl or 2-octyldodecyl.

In one embodiment, the friction modifier may be selected from the group consisting of long chain fatty acid derivatives of amines, fatty esters, or fatty epoxides; fatty alkyl citrates, fatty alkyl tartrates; fatty alkyl tartrimides; and fatty alkyl tartramides.

In one embodiment, the friction modifier may be a long chain fatty acid ester. In another embodiment, the long chain fatty acid ester may be a mono-ester and in another embodiment the long chain fatty acid ester may be a triglyceride.

Other performance additives such as corrosion inhibitors include those described in paragraphs 5 to 8 of WO2006/047486, octyl octanamide, condensation products of dodecenyl succinic acid or anhydride and a fatty acid such as oleic acid with a polyamine. In one embodiment, the corrosion inhibitors include the Synalox® (a registered trademark of The Dow Chemical Company) corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles.

Foam inhibitors include polysiloxane or copolymers of ethyl acrylate and 2-ethylhexyl acrylate and optionally vinyl acetate.

Demulsifiers include trialkyl phosphates, polyethylene glycols, polyethylene oxides, polypropylene oxides and (ethylene oxide-propylene oxide) polymers.

Pour point depressants include esters of maleic anhydride-styrene, polymethacrylates, polyacrylates or polyacrylamides.

Demulsifiers include trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene, poly(meth)acrylates, polyacrylates or polyacrylamides.

In different embodiments, the lubricating composition may have a composition as described in the following Table:

| | Embodiments (wt %) | | |
|---|---|---|---|
| Additive | A | B | C |
| Thiocarbamate | 0.025 to 2 | 0.05 to 1.0 | 0.1 to 0.5 |
| Boron-Containing Compound | 0.0005 to 0.2 | 0.0015 to 0.06 | 0.0020 to 0.03 |
| Dispersant | 0.05 to 12 | 0.75 to 8 | 0.5 to 6 |
| Dispersant Viscosity Modifier | 0 to 5 | 0 to 4 | 0.05 to 2 |
| Overbased Detergent | 0 to 15 | 0.1 to 10 | 0.2 to 8 |
| Antioxidant | 0 to 15 | 0.1 to 10 | 0.5 to 5 |
| Antiwear Agent | 0 to 15 | 0.1 to 10 | 0.3 to 5 |
| Friction Modifier | 0 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |

-continued

| | Embodiments (wt %) | | |
|---|---|---|---|
| Additive | A | B | C |
| Oil of Lubricating Viscosity | Balance to 100% | Balance to 100% | Balance to 100% |

INDUSTRIAL APPLICATION

The lubricating composition may be utilized in an internal combustion engine. The engine components may have a surface of steel or aluminum (typically a surface of steel).

An aluminum surface may be derived from an aluminum alloy that may be a eutectic or hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment, the internal combustion engine may be a diesel fuelled engine (typically a heavy duty diesel engine), a gasoline fuelled engine, a natural gas fuelled engine or a mixed gasoline/alcohol fuelled engine. In one embodiment, the internal combustion engine may be a diesel fuelled engine and in another embodiment a gasoline fuelled engine. In one embodiment, the internal combustion engine may be a heavy duty diesel engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulfur, phosphorus or sulfated ash (ASTM D-874) content. The lubricating composition may be characterized as having at least one of (i) a sulfur content of 0.2 wt % to 0.4 wt % or less, (ii) a phosphorus content of 0.08 wt % to 0.15 wt %, and (iii) a sulfated ash content of 0.5 wt % to 1.5 wt % or less. The lubricating composition may be characterized as having (i) a sulfur content of 0.5 wt % or less, (ii) a phosphorus content of 0.1 wt % or less, and (iii) a sulfated ash content of 0.5 wt % to 1.5 wt % or less.

In one embodiment, the lubricating composition may be characterized as having a sulfated ash content of 0.5 wt % to 1.2 wt %.

The following examples provide illustrations of the invention. These examples are non-exhaustive and are not intended to limit the scope of the invention.

EXAMPLES

Preparation of Borate Esters

To a 500-mL, 3-neck round-bottomed flask equipped with an overhead mechanical stirrer, Dean Stark strap, Friedrich's condenser, thermocouple, and a vapor-space nitrogen purge past the Dean Stark trap and condenser, boric acid and the corresponding alcohols are charged. Vapor-space nitrogen purge is set to 0.5 scfh.

The slurry is slowly heated to 180° C. over a period of about 7 hours. Water is collected in the Dean Stark trap. The solid boric acid dissolves during the course of the reaction, giving a clear liquid. The product is filtered through filter paper with FAX 5 to remove a small amount of trace haze. The product was a clear, colorless liquid.

ADD B-1: Reaction product of 1 eq. of boric acid and 3 eq. of n-octanol.

ADD B-2: Reaction product of 1 eq. of boric acid and 3 eq. of n-decanol.

ADD B-3: Reaction product of 1 eq. of boric acid and 3 eq. of n-dodecanol.

ADD B-4: Reaction product of 1 eq. of boric acid and 3 eq. of 2-ethyl hexanol.

ADD B-5: Reaction product of 1 eq. of boric acid and 3 eq. of 2-propyl heptanol

ADD B-6: Reaction product of 1 eq. of boric acid and 2 eq. of 2-propyl heptanol

ADD B-7: Reaction product of 1 eq. of boric acid and 3 eq. of 2-butyl octanol.

ADD B-8: Reaction product of 1 eq. of boric acid and 3 eq. of 2-hexyl decanol.

ADD B-9: Reaction product of 1 eq. of boric acid and 2 eq. of 2-hexyl decanol.

ADD B-10: Reaction product of 1 eq. of boric acid and 3 eq. of tridecyl alcohol.

ADD B-11: Tributyl borate (Purchased from Sigma-Aldrich)

ADD B-12: Monoethanolamine Borate (MEAB) (Available from ExxonMobil).

Synthesis of Thiocarbamates:

ADD T1: At room temperature a 500 mL 2-neck round bottom flask equipped with a nitrogen inlet and thermocouple is charged with 100 g of toluene, 111 g of isophorone diisocyanate and a catalytic amount of triethylamine (1 g). 202 g of N-dodecyl thiol is added slowly to keep the solution temperature below 40° C. The contents of the flask are stirred for 2 hours whilst partially sub-merged in a water bath. The temperature is maintained to ensure it does not rise above 40° C. After vacuum stripping, 245 g of a white product is obtained.

ADD T-2: At room temperature a 500 mL 2-neck round bottom flask equipped with a nitrogen inlet and thermocouple is charged with 50 g of tetrahydrofuran, 25 g of cyclohexyl isocyanate and a catalytic amount of triethylamine (1 g). 40.4 g of N-dodecyl thiol is added slowly over a period of 20 minutes. The contents of the flask are stirred for 48 hours. After vacuum stripping, 62.6 g of a white product is obtained.

ADD T-3: At room temperature a 1 L 4-neck round bottom flask equipped with a nitrogen inlet and thermocouple is charged with 100 g of toluene, 150 g of methylene-di-p-phenyl-diisocyanate, 242 g of dodecylmercaptan and a catalytic amount of triethylamine (10 drops). The contents of the flask are stirred at room temperature for 3 hours. The flask is then heated to 50° C. and held for 4 hours. After vacuum stripping, 385 g of a white product is obtained.

ADD T-4: To a 4-necked 500 mL round bottom flask equipped with a mechanical stirrer, thermowell, nitrogen inlet, and Friedrich's condenser is added phenyl isocyanate (47.6 g, 0.4 mol) and 60 ml of toluene. The reaction is capped with nitrogen, and stirred moderately. To the solution is added 6 drops of triethyl amine, which is followed by the dropwise addition of n-dodecyl mercaptan (81 g, 0.4 mol) in 30 minutes. There is a strong exotherm of 35° C. observed during the whole process. The solution is stirred for another 1 hours at this temperature. The solution is then heated to 55° C., and held for 5 hours. The flask is cooled to room temperature. The solvent is evaporated under vacuum (60° C./10 mmHg (or 1013 Pa)). A total of 128 g of white solid product is produced (100% yield).

ADD T-5: To a 4-necked 500 mL round bottom flask equipped with a mechanical stirrer, thermowell, nitrogen inlet, and Friedrich's condenser is added hexamethylene diisocyanate (25.2 g, 0.15 mol) and 100 ml of toluene. The reaction is capped with nitrogen, and stirred moderately. To the solution is added 5 drops of triethyl amine, which is followed by the dropwise addition of n-dodecyl mercaptan (60.6 g, 0.3 mol) over a period of 1 hour. The reaction has an exotherm of 30° C. The flask is then heated to 75° C., and held for 5 hours. The reaction is monitored by IR analysis until the IR spectra remains unchanged. After about 5 hours, the flask is cooled followed by solvent extraction in vacuum oven at 40° C. A total of 84 g of white loss solid product is produced (98% yield).

ADD T-6: To a 4-necked 500 mL round bottom flask equipped with a mechanical stirrer, thermowell, nitrogen inlet, and Friedrich's condenser is added toluene diisocyanate (26.1 g, 0.15 mol) and 60 ml of toluene. The reaction is capped with nitrogen, and stirred moderately. To the solution is added 5 drops of triethyl amine, which is followed by the dropwise addition of n-dodecyl mercaptan (60.6 g, 0.30 mol) over a period of 30 minutes. There is an exotherm of 32° C. The flask is heated to 90° C., and held for a total of around 2 hours. The reaction is monitored by IR analysis until the IR spectra remains unchanged. The flask is cooled and solvent is evaporated in vacuum oven at 40° C. A total of 84.5 g of white solid product is produced (97% yield).

ADD T-7: To a 4-necked 500 mL round bottom flask equipped with a mechanical stirrer, thermowell, nitrogen inlet, and Friedrich's condenser is added hexamethylene diisocyanate (20.2 g, 0.12 mol) and 40 ml of toluene. The reaction is capped with nitrogen, and stirred moderately. To the solution is added 10 drops of triethyl amine, followed by the dropwise addition of 2-ethyl hexanol (15.6 g, 0.12 mol) over a period of 10 minutes. The reaction temperature is increased to 92° C. The flask is held at 92° C. and the contents stirred for 1.5 hours. n-dodecyl mercaptan is added (24.2 g, 0.12 mol) over a period of 20 minutes. The flask is then heated to 96° C. and held for 4 hours. The reaction is monitored by IR analysis until the IR spectra remains unchanged. The flask is cooled and solvent is extracted under vacuum. 58 g of white solid product (97% yield) is obtained.

ADD T-8: To a 4-necked 500 mL round bottom flask equipped with a mechanical stirrer, thermowell, nitrogen inlet, and Friedrich's condenser is added isophorone diisocyanate (22.2 g, 100 mmol) and 30 ml of toluene. The reaction is capped with nitrogen, and stirred moderately. To the solution is added 10 drops of triethyl amine, followed by the addition of tolyl triazole (6.6 g, 50 mmol) and 3-amino-1,2,4-triazole (4.2 g, 50 mmol). The flask is heated to 70° C., and held for 2 hours. The resultant solution has a very light hint of haze at the end of this process. To the solution is added dropwise n-dodecyl mercaptan (20.2 g, 100 mmol) over a period of 20 minutes. The flask is then heated to 90° C. and held for 2.5 hours. The solvent is evaporated under vacuum (70° C./3 mmHg (or 303.9 Pa)). A total of 54 g of product is produced (100% yield).

Lubricant Examples 1 (EX1) to 17 (EX17)

A series of 15 W-40 engine lubricants in Group II base oil of lubricating viscosity are prepared containing the additives described above as well as conventional additives including polymeric viscosity modifier, ashless succinimide dispersant, overbased detergents, antioxidants (combination of phenolic ester, diarylamine, and sulfurized olefin), zinc dialkyldithiophosphate (ZDDP), as well as other performance additives. All of the lubricants were prepared from a common formulation as follows in Table 1.

TABLE 1

Lubricating Oil Composition Base Formulation[1]

| | Baseline |
|---|---|
| Group II Base Oil | Balance to 100% |
| Calcium overbased detergent[2] | 1.73 |
| Zinc dialkyldithiophosphate | 1.09 |
| Antioxidant | 1.23 |
| Active Dispersant[3] | 4.76 |
| Viscosity Modifier | 0.56 |
| Additional additives[4] | 1.16 |
| % Phosphorus | 0.11 |

[1]All concentrations are on an oil free (i.e. active basis)

[2]Combination alkylsulfonate and sulfur-coupled alkylphenol

[3]2200 Mn PIBsuccinimide dispersant (TBN ~55)

[4]Additional additives include friction modifiers, foam inhibitors, Surfactant, and soot DVM booster The additives of the invention were added to the baseline oil above as summarized in Table 2

TABLE 2

Lubricating Oil Composition Formulations

| | B-2 | B-4 | B-5 | B-7 | B-8 | B-10 | T-1 | T-2 | T-4 | T-8 | B ppm |
|---|---|---|---|---|---|---|---|---|---|---|---|
| EX1 | | | | | | | | | | | 0 |
| EX2 | 0.45 | | | | | | | | | | 100 |
| EX3 | | 0.37 | | | | | | | | | 100 |
| EX4 | | | 0.44 | | | | | | | | 100 |
| EX5 | | | | 0.52 | | | | | | | 100 |
| EX6 | | | | | 0.71 | | | | | | 100 |
| EX7 | | | | | | 0.56 | | | | | 100 |
| EX8 | | | | | | | 0.1 | | | | 0 |
| EX9 | | | | | | | | 0.1 | | | 0 |
| EX10 | | | | | | | | | 0.1 | | 0 |
| EX11 | | | | | | | | | | 0.1 | 0 |
| EX12 | | 0.1 | | | | | | | 0.1 | | 27 |
| EX13 | | 0.1 | | | | | | | | 0.1 | 27 |
| EX14 | | 0.4 | | | | | | | 0.1 | | 110 |
| EX15 | | 0.4 | | | | | | | | 0.1 | 110 |
| EX16 | | | 0.22 | | | | | | 0.1 | | 50 |
| EX17 | | | 0.44 | | | | | | | 0.1 | 100 |

The lubricants described above are evaluated in copper and lead bench corrosion tests according to the ASTM D6594 High Temperature Corrosion Bench Test (HTCBT). The amount of lead (Pb) and copper (Cu) in the oils at the end of test is measured and compared to the amount at the beginning of the test. Lower lead and copper content in the oil indicates decreased lead and copper corrosion. Overall the results obtained for each lubricant are as follows:

TABLE 3

Corrosion Bench Test

| Example | Pb (ppm) 168 hr | Cu (ppm) 168 hr |
|---|---|---|
| EX1 | 74 | 8 |
| EX2 | 45 | 10 |
| EX3 | 41 | 9 |
| EX4 | 38 | 9 |

TABLE 3-continued

Corrosion Bench Test

| Example | Pb (ppm) 168 hr | Cu (ppm) 168 hr |
|---|---|---|
| EX5 | 36 | 9 |
| EX6 | 52 | 9 |
| EX7 | 38 | 9 |
| EX8 | 14 | 46 |
| EX9 | 13 | 50 |
| EX10 | 13 | 23 |
| EX11 | 29 | 15 |
| EX12 | 8 | 12 |
| EX13 | 24 | 12 |
| EX14 | 10 | 31 |
| EX15 | 22 | 13 |
| EX16 | 9 | 10 |
| EX17 | 8 | 9 |

The data presented indicates that the lubricating composition of the invention (for example, an internal combustion engine lubricant) containing an ashless thiocarbamate compound and a boron-containing compound (EX12-EX17) as defined by the invention provides reduced lead corrosion while not negatively effecting copper corrosion.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade.

However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application US 2010-0197536.

As used herein the term "hydrocarbylene" is used in a similar way as hydrocarbyl, except where the hydrocarbyl group has a carbon atom directly attached to the remainder of the molecule e.g., an alkyl group. In contrast, a hydrocarbylene group is attached to two atoms within the molecule e.g., an alkylene group (e.g., —$CH_2CH_2CH_2$—).

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising:

(a) an oil of lubricating viscosity;

(b) an ashless thiocarbamate compound having an S-atom substituted with a $C_6$ to $C_{20}$ aliphatic hydrocarbon and a N-atom substituted with a $C_6$ to $C_{20}$ aliphatic or aromatic hydrocarbon in an amount from 0.1 wt % to 0.5 wt %; and (c) a boron-containing compound that is the reaction product of boric acid and a $C_8$ to $C_{10}$ alcohol in an amount sufficient to provide 20 ppm to 300 ppm of boron to the lubricating composition.

2. The lubricating composition of claim 1, wherein the ashless thiocarbamate compound is represented by the formula (2):

formula (2)

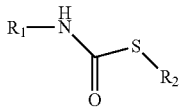

wherein $R_1$ is an aliphatic hydrocarbon group containing 6 to 20 carbon atoms; and $R_2$ is a aliphatic or aromatic hydrocarbon group containing 6 to 20 carbon atoms.

3. The lubricating composition of claim 1, wherein the ashless thiocarbamate compound having an optionally-substituted hydrocarbyl group on an S-atom and an optionally-substituted hydrocarbyl group on an N-atom is represented by the formula (4):

formula (4)

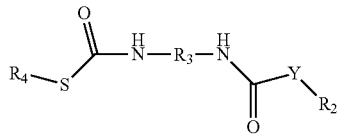

wherein

Y is >O, or >S, or >NH or >$NR_5$;

$R_2$ is a hydrocarbyl group containing 2 to 60 carbon atoms, or a heterocycle or substituted equivalents thereof, with the proviso that $R_2$ is free of a nitrogen-containing heterocycle;

$R_3$ is a hydrocarbylene group containing 1 to 16 carbon atoms, or a heterocycle or substituted equivalents thereof;

$R_4$ is a hydrocarbyl group containing 2 to 60 carbon atoms, or a heterocycle or substituted equivalents thereof; and $R_5$ is a hydrocarbyl group containing 1 to 30 carbon atoms.

4. The lubricating composition of claim 1, wherein one or more of the $C_6$ to $C_{20}$ aliphatic hydrocarbon group substituted on the S-atom and the $C_6$ to $C_{20}$ aliphatic hydrocarbon group substituted on N-atom are linear hydrocarbyl hydrocarbon groups.

5. The lubricating composition of claim 1, wherein one or more of the of the $C_6$ to $C_{20}$ aliphatic hydrocarbon group substituted on the S-atom and the $C_6$ to $C_{20}$ aliphatic hydrocarbon group substituted on N-atom are selected from a linear hydrocarbon group and a branched hydrocarbon group.

6. The lubricating composition of claim 1, wherein one or more of the of the $C_6$ to $C_{20}$ aliphatic hydrocarbon group substituted on the S-atom and the $C_6$ to $C_{20}$ aliphatic hydrocarbon group substituted on N-atom are cyclic hydrocarbon groups.

7. The lubricating composition of claim 1, wherein or more of the of the $C_6$ to $C_{20}$ aliphatic hydrocarbon group substituted on the S-atom and the $C_6$ to $C_{20}$ aliphatic hydrocarbon group substituted on N-atom are selected from a cyclic hydrocarbyl group and a linear hydrocarbyl group.

8. The lubricating composition of claim 1, wherein the lubricating composition is characterized as having (i) a sulfur content of 0.5 wt % or less, (ii) a phosphorus content of 0.1 wt % or less, and (iii) a sulfated ash content of 0.5 wt % to 1.5 wt % or less.

9. The lubricating composition of claim 1, wherein the lubricating composition is characterized as having at least one of (i) a sulfur content of 0.2 wt % to 0.4 wt % or less, (ii) a phosphorus content of 0.08 wt % to 0.15 wt %, and (iii) a sulfated ash content of 0.5 wt % to 1.5 wt % or less.

10. The lubricating composition of claim 1, wherein the lubricating composition is characterized as having a sulfated ash content of 0.5 wt % to 1.2 wt %.

11. The lubricating composition of claim 1, further comprising at least one of an antiwear agent, a dispersant viscosity modifier, a friction modifier, a corrosion inhibitor (other than the ashless thiocarbamate compound of claim 1) a viscosity modifier, an antioxidant, an overbased detergent, or mixtures thereof.

12. The lubricating composition of claim 11, wherein the friction modifier is selected from the group consisting of long chain fatty acid derivatives of amines, long chain fatty esters, long chain fatty epoxides; fatty imidazolines; amine salts of alkylphosphoric acids; fatty alkyl citrates, fatty alkyl tartrates; fatty alkyl tartrimides; and fatty alkyl tartramides.

13. The lubricating composition of claim 1, wherein the composition is free of long chain fatty esters.

14. The lubricating composition of claim 1, further comprising a dispersant viscosity modifier.

15. The lubricating composition of claim 1, further comprising a phosphorus-containing antiwear agent.

16. The lubricating composition of claim 1, further comprising an overbased detergent selected from the group consisting of phenates, sulfur containing phenates, sulfonates, salixarates, salicylates, and mixtures thereof.

17. The lubricating composition of claim 16, wherein the overbased detergent is present at 1 wt % to 10 wt %.

18. The lubricating composition of claim 1, further comprising a succinimide dispersant.

19. The lubricating composition of claim 18, wherein the succinimide dispersant is present at 2.5 wt % to 6 wt %.

20. The lubricating composition of claim 1, wherein the lubricating composition has a TBN in the range of 3 to 15 mg KOH/g.

21. A method of lubricating an internal combustion engine comprising supplying to the internal combustion engine a lubricating composition of claim 1.

22. The method of claim 21, wherein the internal combustion engine is lubricated with a lubricating composition of claim 1, and wherein the engine has a steel surface on a cylinder bore, a cylinder block, or a piston ring.

23. A method of lubricating a heavy duty diesel internal combustion engine comprising supplying to the heavy duty diesel internal combustion engine a lubricating composition of claim 1.

24. The lubricating composition of claim 1, wherein the boron-containing compound is a borate ester.

25. The lubricating composition of claim 1, wherein the boron-containing compound is a borated fatty acid ester of glycerol.

* * * * *